US005914087A

United States Patent [19]

Fuchs et al.

[11] Patent Number: 5,914,087

[45] Date of Patent: Jun. 22, 1999

[54] PROCESS AND DEVICE FOR CLOSING A TAP HOLE

[75] Inventors: Reinhard Fuchs, Wassenberg; Werner Hofmann, Moers, both of Germany

[73] Assignee: Mannesmann AG, Düsseldorf, Germany

[21] Appl. No.: 09/068,602

[22] PCT Filed: Nov. 4, 1996

[86] PCT No.: PCT/DE96/02133

§ 371 Date: May 11, 1998

§ 102(e) Date: May 11, 1998

[87] PCT Pub. No.: WO97/18050

PCT Pub. Date: May 22, 1997

[30] Foreign Application Priority Data

Nov. 10, 1995 [DE] Germany ..... 195 43 058

[51] Int. Cl.[6] ..... B22D 41/46; B22D 41/14

[52] U.S. Cl. ..... 266/45; 266/272; 222/590; 222/602

[58] Field of Search ..... 222/590, 591, 222/597, 601, 602, 600; 266/45, 236, 218, 271, 272

[56] References Cited

U.S. PATENT DOCUMENTS 4,736,930 4/1988 Weber et al. ..... 266/272

FOREIGN PATENT DOCUMENTS 3437810 4/1986 Germany .
3826245 2/1990 Germany .
8806068 8/1988 WIPO .

*Primary Examiner*—Scott Kastler
*Attorney, Agent, or Firm*—Cohen, Pontani, Lieberman & Pavane

[57] ABSTRACT

A process for closing a tap hole in a metallurgical vessel at least partially filled with a metal melt includes bringing a compressible fire-resistant material to the moth of a tubular closing element, providing a medium that substantially prevents contact between the fire resistant material and the metal melt, passing the closing element through the melt toward the bottom of the vessel, compressing the compressible material against the bottom of the vessel to form a seal between the outside of the closing element and the tap hole below the closing element, and moving a cut off device over the outside of the tap hole, thereby allowing the tap hole to be filled with a pourable refractory compound via the tubular closing element. A device for performing the process for closing a tap hole includes a tubular closing device with a groove at an end bottom facing the bottom of the metallurgical vessel. The open end of the groove also faces the bottom of the vessel and a closed end of the groove includes a compressible material. The sides of the groove are deflectable such that when the closing device is lowered onto the bottom of the vessel, the compressible material contacts the bottom of the vessel forming a seal.

15 Claims, 3 Drawing Sheets

PROCESS AND DEVICE FOR CLOSING A TAP HOLE

BACKGROUND

1. Field of the Invention

The invention relates to a process for closing a tap hole in the bottom of a vessel filled with a metal melt, especially a vessel for a steel melt, with a tubular closing element that is vertically movable toward and away from the entrance of the tap hole, and with a cut-off device below the vessel bottom. The invention also relates to a device for implementing a process for closing the tap hole.

2. Description of the Prior Art

The pool method for tapping a metallurgical vessel, especially a vessel for steel, uses closing systems that allow a residue of metal melt and slag to be retained in the vessel. As a rule, such vessels are designed to be tiltable, so that the closing system is not exposed to wear from the molten metal or slag.

For example, reference DE 34 37 810 discloses a closing device for a tap hole in the bottom of a metallurgical vessel, wherein a cut-off device is provided outside of and below the metallurgical vessel wherein the lower cut-off device can be moved against the tap hole from the outside. In the vessel interior, a tube is lowered from a release position into the closing position. The mouth of the tube rests against the edge of the tap hole. When the tube is in the lowered, closing position, pourable filling material is passed through the tube into the tap hole.

It is further proposed in DE 34 37 810 that the tube be closed at the foot end and that a gas be introduced into the interior to prevent the melt from entering the tube through the lower tube mouth.

In addition to experiencing high wear, the above closing device has the disadvantage of low imperviousness. In rough steel mill operation, erosion occurs at the entrance of the tap hole. Furthermore, the aggressive slag and the high melt temperatures destroy the lower edge of the closing device irregularly.

SUMMARY OF THE INVENTION

The object of the invention is to create a process and a suitable device for repeatedly closing a tap hole of a metallurgical vessel which has a high overall useful life and ensures reliable cut-off without requiring the vessel to be tilted as in the pool method.

The object is attained by a device for closing a tap hole in the bottom of a metallurgical vessel with a tubular closing element having a forked groove, the opening of which faces the vessel bottom. The blind end of the groove is filled with a compressible material and the remainder of the interior of the groove is fillable with a gas. The walls of the groove includes a material which does not resist the pressing of the closing element against the vessel bottom.

The object is further attained by a process for closing a tap hole in the bottom of a metallurgical vessel including the steps of bringing a compressible fire-resistant material to the mouth of a closing element, providing a medium in front of the fire-resistant material in the closing direction to substantially prevent contact between the fire resistant metal and the melt, passing the mouth of the closing element through the melt and pressing the closing element against the vessel bottom with such force that the fire resistant material is compressed, and moving a cut-off device in front of the outside of the tap hole such that the tap hole is fillable with a pourable compound via the closing element.

According to the invention, a compressible material is provided on the face of the closing element and, for the purpose of sealing, is compressed during contact with the vessel bottom in the region of the tap hole.

During passage of the closing element through the melt, which has temperatures between 1500 and 1700° C., the compressible sealing material is protected against the effects of the melt and the molten metal. Thus, the compressible material used for sealing is a fire-resistant material, and this material is introduced into a groove located on the face of the closing device, specifically, into the inner area of the groove directed away from the mouth. The remaining interior of the groove is left free and serves as a chamber for a gas that protects the sealing material during its passage through the melt.

This gas may originate from a solid or a liquid medium, which is applied to the compressible material and gasified by heat. In a further advantageous embodiment, the gas may be supplied continuously in the form of a gas; or, a gas may be used that expands due to heat during the residence time of the compressible material in the melt bath (which experience has shown to be less than 30 seconds) and displaces the melt. The total volume of the gas is thereby sufficient to maintain this process over the entire time.

The complete closing process is as follows: The tubular closing element passes through the slag and molten melt in the upright furnace until it touches the vessel bottom and seals the latter tightly against an outflow of the melt. At this time, the tap hole is still open, so that the melt and slag located in the interior of the tubular element and in the tap hole exit the furnace vessel. After this, a cut-off device (a slider or flap) arranged outside of the vessel is closed. It is then possible to inspect the tap hole. This may be done by direct visual inspection or even by a camera or an endoscope. Furthermore, a tool may be passed through the tubular closing element to treat the tap hole, for instance, to remove skull. In addition, a device for repairing the refractory material, such as a gunning device, may be inserted through the tubular closing element into the tap hole. When the tap hole is found to be usable, a pourable material is introduced into the tap hole in a known manner. This protects the cut-off device and eases casting after the cut-off is opened.

In an advantageous embodiment, the head of the closing element is designed as an exchangeable part. After one or more closing procedures, or needed, the exchangeable part is exchanged and equipped with a new sealing lip comprising the a groove and the compressible fire- resistant material.

The exchangeable part may have a wall thickness clearly greater than that of the rest of the tubular closing element.

The walls of the groove protect the sealing material during the passage through the melt. When the sealing material, such for example, as a blanket or a formed piece made of fibers, has reached the bottom of the metallurgical vessel, the material of the groove walls should not interfere with the compression of the sealing material. One suitable material would be a metal material, embodied in the form of a compensator. Further, a metal material that at least softens, melts or carbonizes after passing through the melt in roughly 15 to 30 seconds may also be used. Thus, a paperboard that has an adequate working life and carbonizes upon contact with the melt may be used.

It is further proposed that the base of the groove be designed to adjust to the conditions of the entrance of the tap hole. The face of the exchangeable part may thereby have a conical surface that peaks in the direction of the center axis.

However, the base of the groove may also have a shape corresponding to the entrance shape of the tap hole, so that the thickness of the subsequently compressed sealing mass, i.e., the fire-resistant fibers, remains virtually constant. In this way, especially high imperviousness is reliably achieved.

BRIEF DESCRIPTION OF THE DRAWINGS

In the drawings, wherein the reference characters denote similar elements throughout the several views.

DETAILED DESCRIPTION OF THE PREFERRED EMBODIMENT

Figure 1:
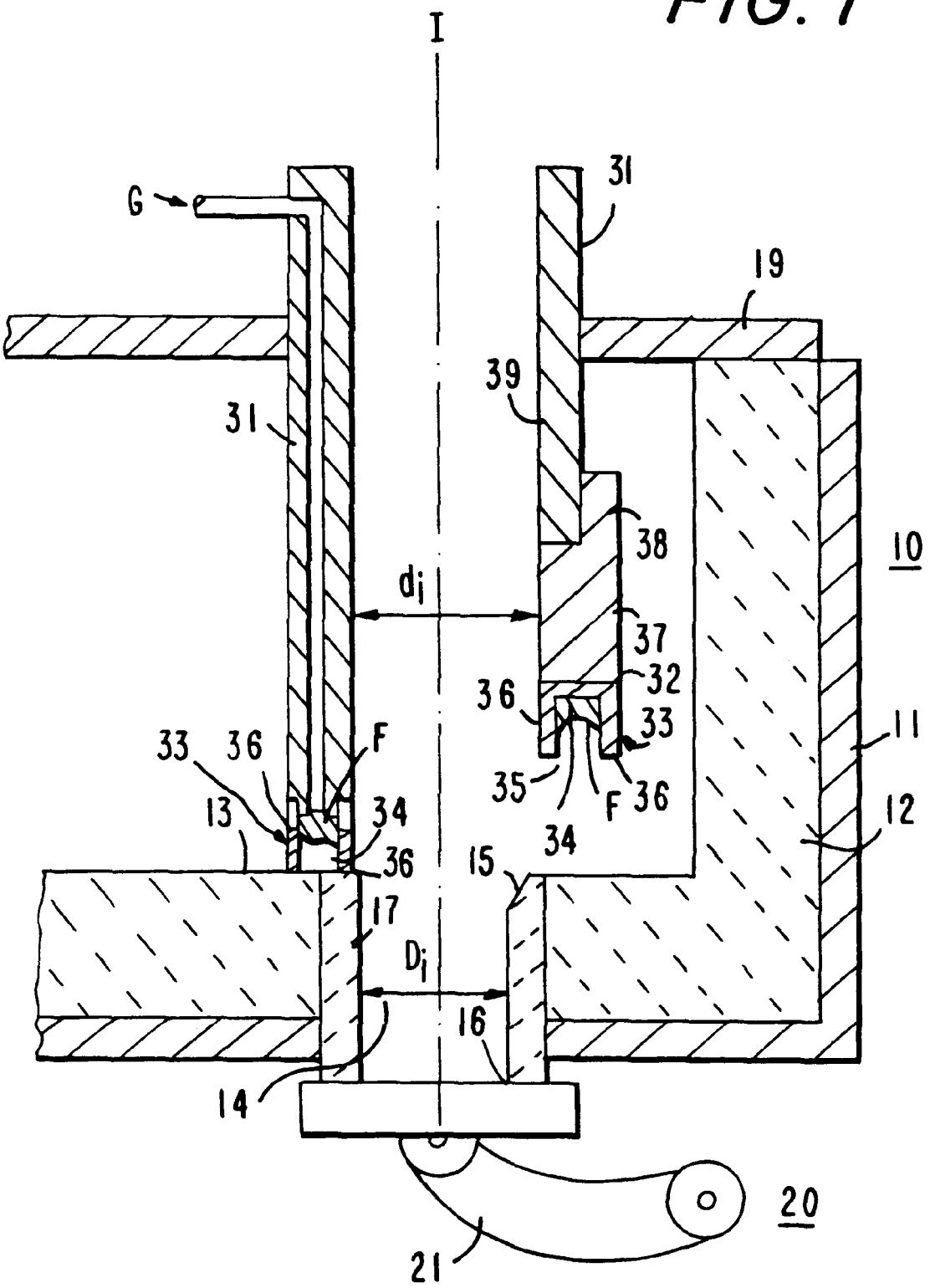
FIG. 1 is a sectional view of a metallurgical vessel showing two embodiments of a closing element in accordance with the invention.

FIG. 1 shows a section through part of a metallurgical vessel 10 with a vessel mantle 11 and a refractory vessel lining 12. The vessel bottom 13 includes a tap hole 14 whose mouth 16 is closed by a cut-off device 20, which is shown as a flap 21.

The tap hole 14 has a refractory lining 17, which may have a conical slant in the region of the entrance 15.

A tubular closing element 31, on whose front face there is a groove 33, runs in the metallurgical vessel 10. The metallurgical vessel 10 may be covered by a lid 19. FIG. 1 shows two embodiments of closing element 31 on the right and left sides of longitudinal axis I. A compressible material F is introduced into a groove 34. In the embodiment shown on the right side of the closing element 31, an exchangeable head 37 is attached to the main body 39 by a detachable connection 38.

In the embodiment shown on the side of the axis I, the closing element 31 comprises a boring through which a gas G can be conveyed into the groove interior 34 or the groove 33. In FIG. 1, the internal diameter $d_i$ of the closing element 31 is equal to or greater than the diameter $D_i$ of the tap hole 14. The ratio of $d_i$ to $D_i$ is preferably from 0.7 to 2.0.

Figure 2:
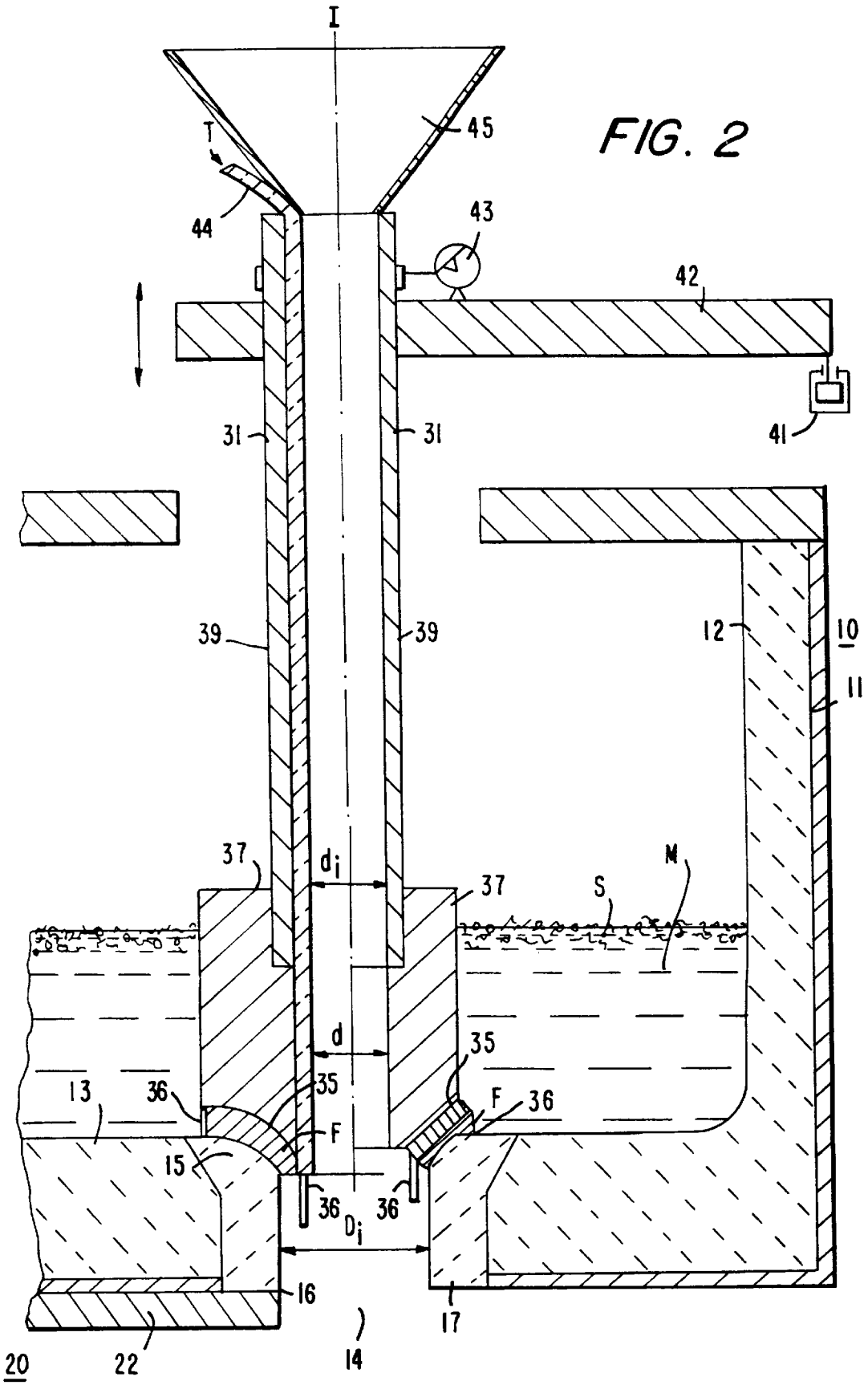
FIG. 2 is a sectional view of a metallurgical vessel showing two more embodiments of a closing element in accordance with the invention.

FIG. 2 shows a metallurgical vessel 10 filled with a metal melt M, on which slag S floats. The vessel 10 is covered by a lid 19, through which the main body 39 of the closing element 31 is run. The closing element 31 is held by a bracket 42, which can be moved vertically by a movement drive 41. In addition, the closing element 31 is rotatable around its longitudinal axis I by means of a rotary drive 43.

To allow the pourable material to be easily supplied to the tap hole 14, a filling funnel 45 is attached to the main body 39 of the closing element 31. There is also a supply 44 for repair compounds such as a gunning compound T.

The head 37 of the closing element 31 is designed as an exchangeable part. In the embodiment shown on the right side of the drawing, the base 35 is slanted, while walls 36 of the groove 33 run axis-parallel to the longitudinal axis I. In the embodiment shown on the left side of the drawing, the base 35 is adjusted to the current state of the entrance 15 of the refractory lining 17 of the tap hole 14. The walls 36 also run axis-parallel to the longitudinal axis I.

FIG. 2 shows the compressible material F between the two bases 35 and the respective entrance segments 15. The compressible material F is shown in the deformed state, in which it forms a tight seal between the molten metal melt M and the tap hole 14.

In FIG. 2, the mouth 16 of the tap hole 14 can be closed by a cut-off device 20, here, a slider 22.

In FIG. 2, the internal diameter $d_i$ of the closing element 31 is smaller than the internal diameter $D_i$ of the tap hole 14.

Figure 3:
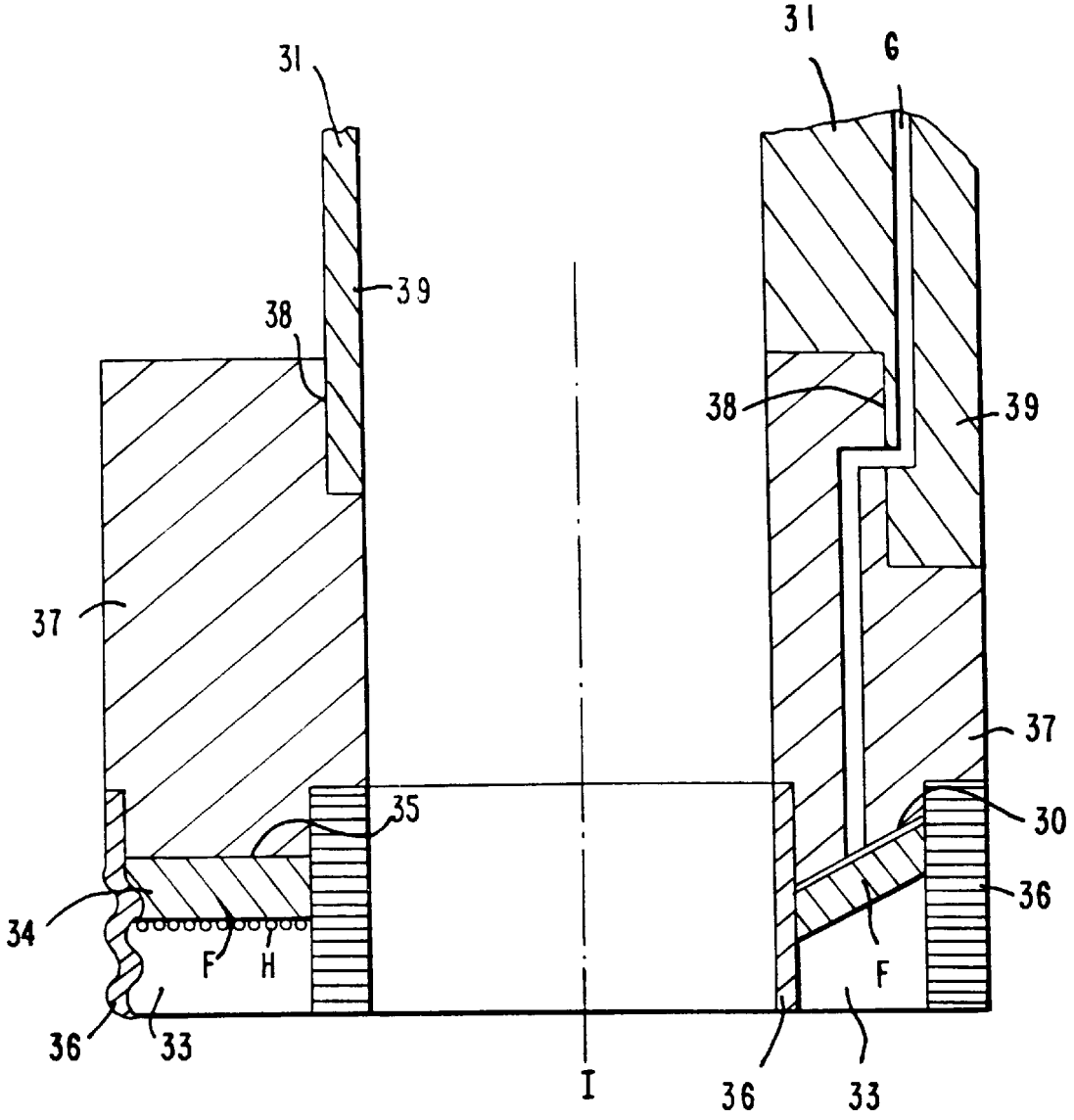
FIG. 3 is a sectional view showing two embodiments of an exchangeable part of the closing element of the invention.

FIG. 3 shows the main body 39 of closing element 31 and the exchangeable part 37 attached thereto via a detachable connection 38. In the embodiment shown in the left half of the drawing, the groove 33 has a base 35 arranged at a right angle to the main axis I. The groove 33 also has walls 36, which are embodied on the left side as a compensator and on the right side, for example, from paperboard. In the interior 34 of the groove 33, there is compressible material F. An empty space, in which gas can collect, remains, reaching to the mouth of the walls 36. The gas G is collected from a liquid or solid medium H after its transition into the gaseous phase due to heat. In the preferred embodiments, the walls 26 have a thickness of 0.3 to 20 mm.

On the embodiment shown on the right side of the drawing, the base 35 of the groove 33 with the walls 36 is slanted. The compressible material F, embodied as a formed piece, is placed in front of this slanted base 35. A gas G can be conveyed to the groove 33 via a boring through the main body 39 and the exchangeable part 37.

We claim:

1. A process for closing a tap hole in the bottom of a metallurgical vessel that is filled with a metal melt with a vertically movable tubular closing element and with a cut-off device below the vessel bottom, comprising the steps of:

placing a fire-resistant material on a mouth of the closing element;

passing the mouth of the closing element through the metal melt;

providing a quantity of a medium on a front the fire-resistant material for substantially preventing contact between the fire-resistant material and the metal melt when the closing device is passed through the metal melt;

compressing the mouth of the closing element against the bottom of the metallurgical vessel thereby providing a seal between the metal melt and the tap hole; and moving a cut-off device in front of a bottom of the tap hole thereby allowing the tap hole to be filled with a pourable refractory compound via the tubular closing element.

2. The process of claim 1, further comprising the step of rotating the tubular closing element about its central axis after said step of compressing the mouth of the closing element against the bottom of the metallurgical vessel.

3. The process of claim 1, wherein said step of providing a quantity of a medium comprises providing a quantity of a gas medium.

4. The process of claim 1, wherein said step of providing a quantity of a medium comprises providing a quantity of nitrogen.

5. The process of claim 3, wherein said step of passing the mouth of the closing element comprises passing the mouth and the gas medium through the metal melt.

6. The process of claim 1, wherein said step of providing a quantity of a medium comprises providing a quantity of one of a liquid and solid material that transforms into a gaseous phase and creating a gas when the closing element is passed through the metal melt; and said step of passing the mouth of the closing element through the metal melt comprises passing the mouth of the closing element through the metal melt wherein said gas lies protectively in front of the fire-resistant material.

7. A device for closing a tap hole in the bottom of a metallurgical vessel, comprising:

a tubular closing element vertically movably mounted in said metallurgical vessel and having a lower end and an upper end;

a forked groove having a blind end and an open end mounted at the bottom end of said tubular closing element, said open end facing the bottom of the vessel;

a compressible material arranged at the blind end of said groove;

a gas occupying a space in said groove between said compressible material and said open end;

said forked groove comprising flexible walls which provide insubstantial resistance to the advancement of the closing element toward the bottom of the metallurgical vessel such that said compressible material contacts the vessel bottom and creates a seal between the metal melt surrounding said closing element and the tap hole below said closing element when said closing element is in a fully lowered position; and a cut-off device for shutting the tap hole of the metallurgical vessel from the outside of the vessel.

8. The device of claim 7, wherein said flexible walls comprise metal compensators.

9. The device of claim 8, wherein said walls comprise a thickness in the range of 0.3 to 20.0 mm and said walls comprise a metal that softens when exposed to the heat of the metal melt in the vessel.

10. The device of claim 7, further comprising an exchangeable head part exchangeably connected between the tubular closing element and the groove such that the head and groove are exchangeable as one piece.

11. The device of claim 10, wherein said tubular closing element comprises a first wall thickness and said head part comprises a second wall thickness wherein said second wall thickness is in the range of 3 to 10 times the first wall thickness.

12. The device of claim 11, wherein a ratio of the internal diameter of the closing element $d_I$ to the internal diameter of the tap hole $D_I$, $d_I/D_I$, is in the range of 0.7 to 2.0.

13. The device of claim 7, wherein said compressible material comprises a fire-resistant material.

14. The device of claim 7, wherein said blind end of said groove is conically inclined toward a longitudinal axis of the closing element.

15. The device of claim 7, wherein said blind end comprises a shape corresponding to that of an entrance to said tap hole.

* * * * *